US005887641A

United States Patent [19]

Iwamoto et al.

[11] Patent Number: 5,887,641

[45] Date of Patent: Mar. 30, 1999

[54] INJECTION DEVICE OF A DIE CASTING MACHINE

[75] Inventors: Norihiro Iwamoto, Sagamihara; Yukio Mizota, Numazu; Masayuki Takamura, Oyama, all of Japan

[73] Assignee: Toshiba Kikai Kabushiki Kaisha, Tokyo, Japan

[21] Appl. No.: 699,060

[22] Filed: Aug. 9, 1996

[30] Foreign Application Priority Data

Aug. 9, 1995 [JP] Japan ..... 7-203268

[51] Int. Cl.[6] ..... R22D 17/32

[52] U.S. Cl. ..... 164/155.3; 164/113; 164/155.4; 164/155.5; 164/312; 164/457

[58] Field of Search ..... 164/312, 154.2, 164/154.3, 154.8, 155.3, 155.4, 155.5, 113, 457

[56] References Cited

U.S. PATENT DOCUMENTS

| | | | |
|---|---|---|---|
| 4,252,176 | 2/1981 | Page | 164/155.5 |
| 4,660,620 | 4/1987 | Ozeki | 164/113 X |
| 5,299,626 | 4/1994 | Iwamoto | 164/312 X |
| 5,622,217 | 4/1997 | Iwamoto et al. | 164/312 X |
| 5,662,159 | 9/1997 | Iwamoto et al. | 164/312 X |

FOREIGN PATENT DOCUMENTS

| | | | |
|---|---|---|---|
| 57-202956 | 12/1982 | Japan | 164/155.4 |
| 2-142664 | 5/1990 | Japan | 164/154.3 |

OTHER PUBLICATIONS

Abstract of Japanese Patent Publication 6–39516 Published Feb. 15, 1994.

*Primary Examiner*—J. Reed Batten, Jr.
*Attorney, Agent, or Firm*—Pillsbury Madison & Sutro LLP

[57] ABSTRACT

An injection device of a die casting machine including an injecting cylinder, in which a piston connecting to a piston rod is slidably thrust into a cylinder body and in which pressurized oil is fed to the side of the piston from a pressurized oil source and flows out from the side of the piston rod, and a servo valve controlling an injection speed of the injection cylinder device by controlling the amount of flow of pressurized oil that flows out from the injecting cylinder. The servo valve is directly attached to the cylinder body of the injecting cylinder and a flow channel connecting the injecting cylinder and servo valve is shortened.

9 Claims, 4 Drawing Sheets

INJECTION DEVICE OF A DIE CASTING MACHINE

BACKGROUND OF THE INVENTION

1. Field of the Invention

This invention relates to an injection device of a die casting machine, which includes an injecting cylinder operated with pressurized oil fed from a hydraulic source and a servo valve controlling the injection speed and pressure of the injecting cylinder by controlling flow of the pressurized oil that flows from the injecting cylinder.

2. Description of the Related Art

A die casting machine includes an injection device in order to inject molten material into a cavity of a mold. The injection device includes an injecting cylinder in which a piston, being coupled to a piston rod having an injection plunger at the end of the piston rod, is slidably thrust into the cylinder body.

The injection speed of the injecting cylinder is controlled by controlling the flow of the pressurized oil that flows from the injecting cylinder by using a servo valve.

The conventional injection device of the die casting machine is adopted with a mode in which the pressurized oil is controlled at the entrance side, and further, as cited in Japanese Patent Application Laid-open No. Hei 6-39516, the servo valve is far away from the injecting cylinder, with the result that a long channel connecting the servo valve and the injecting cylinder is formed.

In consequence, the conventional injection device of the die casting machine has a disadvantage in that resistance in the channel is large, which is caused by the long formed channel connecting the servo valve and the injecting cylinder, having a large distance between each other.

Naturally, the pressurized oil cannot flow into the servo valve in large quantities, whereby the conventional injection device has a poor quality of response and is not amenable to change the injection high speed control from the feedback control by either extremely low speed injection or an injection low speed.

An automaker or the like has expected product parts with reduced weight, in order to produce the product, however, the quick, accurate quality of response of the injection device is required, whereby the conventional injection device has limitations for filling the need for reducing weight.

It is an object of the present invention to provide the injection device of the die casting machine, which has a lower resistance in the channel and a quick, accurate quality of response.

SUMMARY OF THE INVENTION

Therefore, the present invention is intended to attain the aforementioned object by directly attaching a servo valve to a cylinder body of an injecting cylinder.

More specifically, an injection device of a die casting machine, which includes an injecting cylinder, having a cylinder body, a piston thrust into the cylinder body in a sliding motion, and a piston rod connected to the piston, with the pressurized oil being fed from the pressurized oil source to the piston side and further flowing out from the side of the piston rod, and a servo valve, controlling the injection speed of the injecting cylinder by controlling the amount of flow of the pressurized oil that flows from the injecting cylinder, is characterized by including a servo valve body provided adjacent to the cylinder body in the servo valve directly attached to the cylinder body of the injecting cylinder; and a spool thrust into the servo valve body in a sliding motion in the servo valve directly attached to the cylinder body of the injecting cylinder, in which the servo valve body includes a rod side port connecting to the side of the piston rod of the injecting cylinder, a pressurized oil feeding port fed with the pressurized oil from the pressurized oil source, and a tank side port for exhausting the pressurized oil to drain, and the spool includes a first pressurized oil flow channel for the pressurized oil, fed from the rod side port, to flow to the tank side port and a second pressurized oil flow channel for the pressurized oil, fed from the pressurized oil feeding port, to flow to the rod side port.

In the present invention, the pressurized oil is fed from a pressurized oil source into the side of the piston of the injecting cylinder, whereupon the piston and the piston rod are moved forward, so that molten material is injected into a mold by an injection plunger provided at the end of the piston rod. By moving the piston rod forward, the pressurized oil flows out from the side of the piston rod of the injecting cylinder, and further, the pressurized oil that flows out has its amount of flow controlled by the servo valve, resulting in control of an injection speed of the injecting cylinder.

At this time, the servo valve is directly attached to the cylinder body of the injecting cylinder, so that a flow channel connecting the injecting cylinder and the servo valve can be shorter, resulting in a small resistance in the channel. Therefore, a large amount of pressurized oil can be flown into the servo valve, with the result that the quality of response of the injection device of the die casting machine is improved.

Here, in the present invention, the first pressurized oil flow channel may be a first ring groove formed on the outer circumference portion of the spool.

When the first pressurized oil flow channel is the first ring groove formed on the outer circumference portion of the spool, by forming the width and depth of the first ring groove to be larger, a large amount of hydraulic fluid can flows in the servo valve, resulting in the further improved quality of response of the injection device of the die casting machine.

The second pressurized oil flow channel may be composed of a hole portion formed in the inside of the spool and a second ring groove formed on the outer circumference portion of the spool and connecting to the hole portion.

With composition of the second pressurized oil flow channel which includes the hole formed in the spool and the second ring groove formed on the outer circumference portion of the spool to connect to the hole portion, the reduction in weight is attained by having the spool formed as a hollow portion and the quality of response of the spool itself is improved, resulting in the further improved quality of response of the injection device of the die casting machine.

The hole portion can be composed of a first through hole with a large diameter, formed to the shaft center of the spool, and a number of secondary through holes with small diameters, connecting the first through hole and the second ring groove and formed in the axis direction of the spool.

The servo valve may be a two-stage servo valve including a main valve having the servo valve body and a pilot valve operating the main valve.

Further, the servo valve may include a displacement detection device for detecting displacement of a spool of the main valve and a displacement detection device for detecting displacement of a spool of the pilot valve, in which the two displacement detection devices are connected to a control means for controlling to make the appropriate proportion between the spool displacement of the main valve and the spool displacement of the pilot valve.

The servo valve body may have a chamber at the opposite side of the spool, in which the pressurized oil is allowed to flow between the chamber and the pressurized oil feeding port.

And further, the inside of the servo valve body and the pilot valve may be structured to be connected through a first oil channel, a second oil channel, a first oil chamber and a second oil chamber, in which the first and second oil channels are arranged to make the shortest distance between the inside of the valve body and the pilot valve.

DETAILED DESCRIPTION OF THE PREFERRED EMBODIMENT(S)

The preferred embodiment of the present invention will be explained in detail below with reference to the attached drawings.

Figure 1:
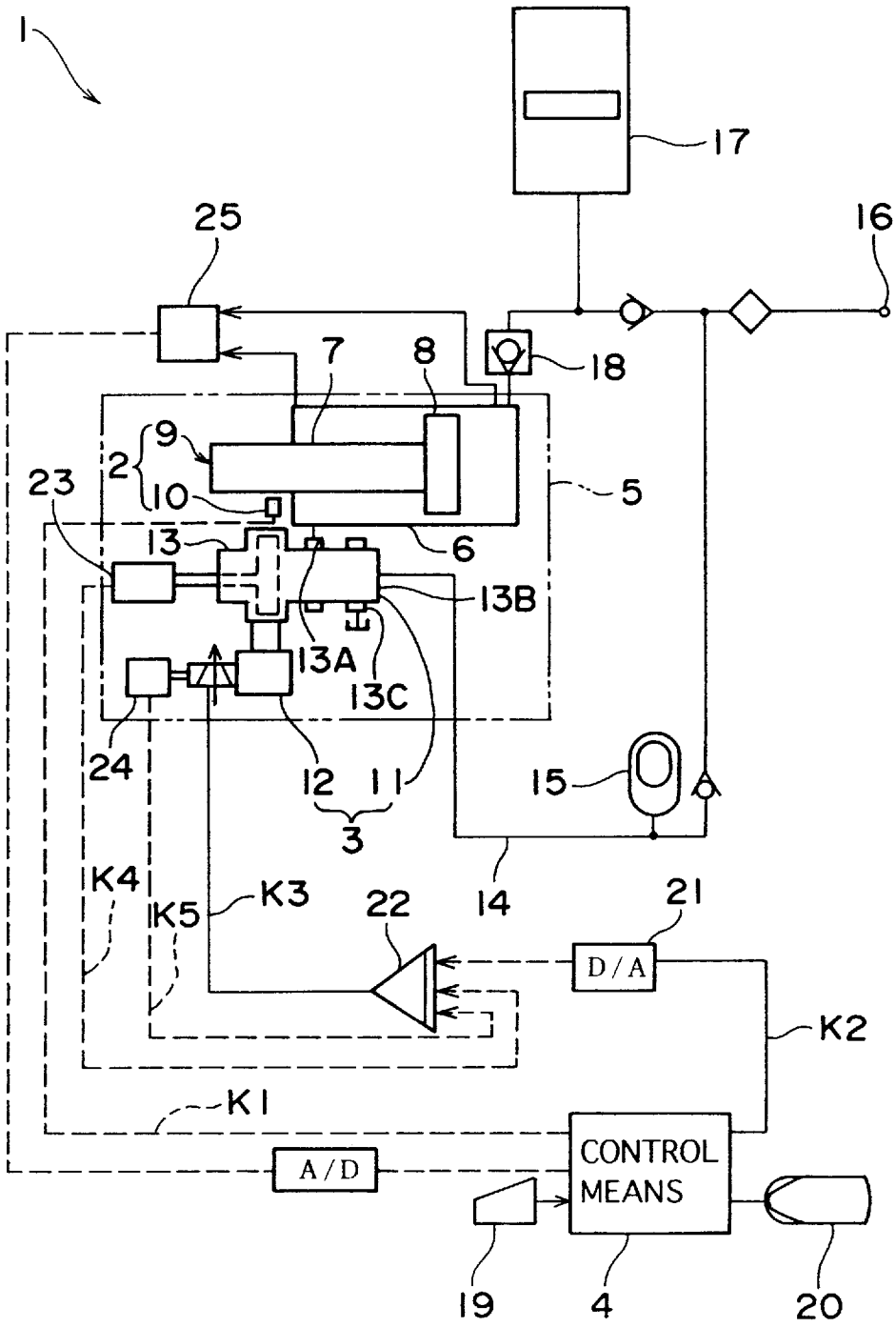
FIG. 1 is a brief block diagram of a die casting machine showing the preferred embodiment of the present invention.
Figure 2:
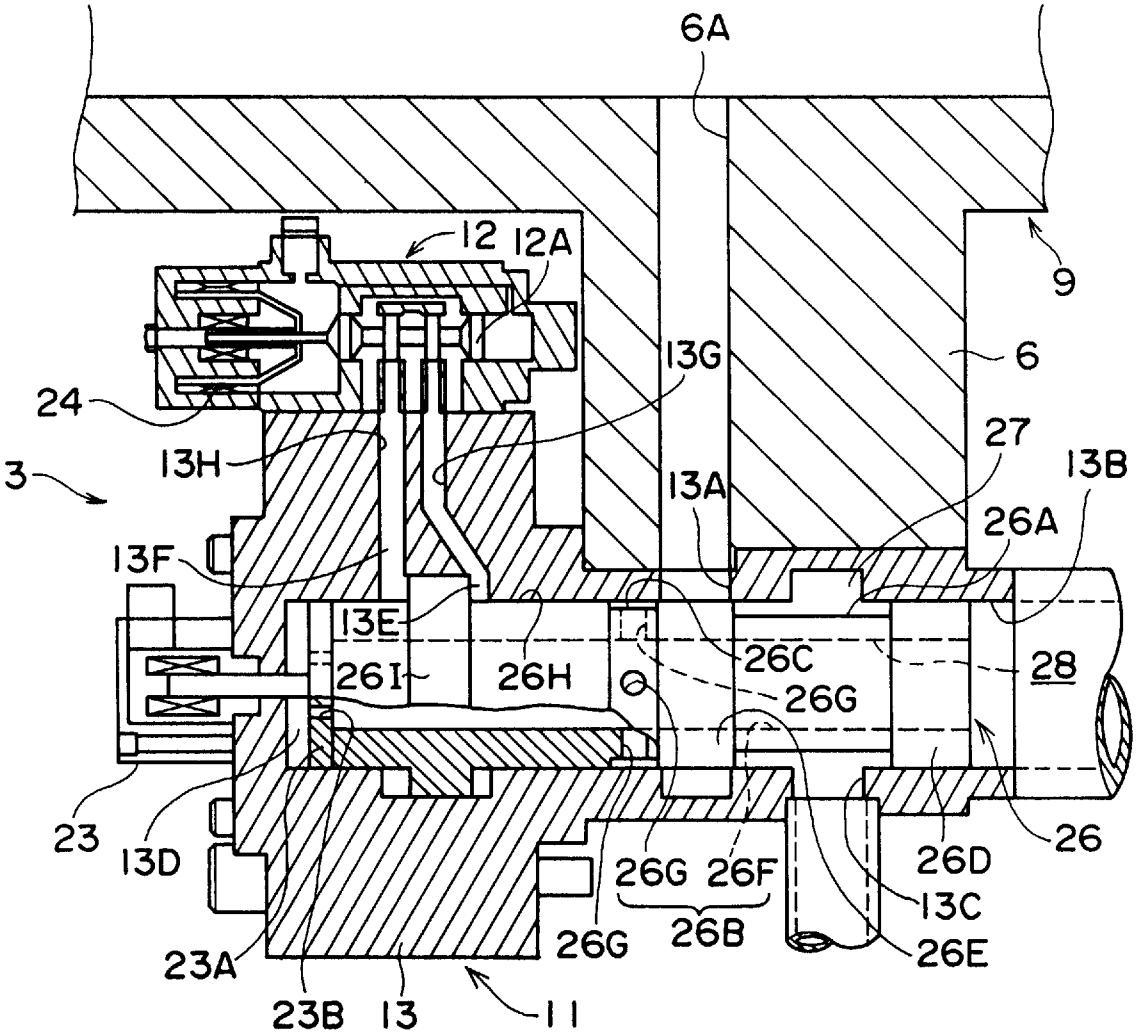
FIG. 2 is a sectional view showing an injection device according to the preferred embodiment.

FIGS. 1 and 2 show the preferred embodiment of the present invention.

In FIG. 1 showing the whole structure, a die casting machine of the embodiment is composed of an injection cylinder device 2 injecting molten material into a mold (not shown), a servo valve 3 for controlling the amount of flow of pressurized oil that flows from the injection cylinder device 2, and a control means 4 for controlling the servo valve 3 with various injection data or the like, in which an injection device 5 of the die casting machine is composed of the injection cylinder device 2 and servo valve 3.

The injection cylinder device 2 includes a cylinder. body 6, an injection cylinder 9 composed of a piston rod 7, having an injection plunger (not shown) sidably thrust into the cylinder body 6 at the end of the piston rod 7, and a piston 8 coupled to the piston rod 7, and a well-known magnet sensor 10 detecting speed movement and stroke movement of the piston rod 7 for the injecting cylinder 9.

The servo valve 3 is of a two-stage servo valve composed of a main valve 11 and pilot valve 12 operating the main valve 11, which controls an injection speed of the piston rod 7 of the injection cylinder device 2 by ,controlling the flow of the pressurized oil that flows from the injecting cylinder 9.

The main valve 11 includes a servo valve body 13, in which the servo has a rod side port 13A connecting the piston rod 7 of the injecting cylinder , a oil feeding port 13B, and a tank side port 13C for exhausting the pressurized oil to drain. The pressurized oil feeding port 13B is connected to a servo pressurized oil source 14, in which a small-sized accumulator 15 is provided in the servo pressurized oil source 14 in order to improve the quality of response of the pilot valve 12. The accumulator 15 is connected to a pressurized oil source 16 using a pressurized oil pump (not shown).

The pressurized oil source 16 is provided with an accumulator 17. Further, a pilot operation opening valve 18 is provided between the pressurized oil source 16 and the head of the injecting cylinder 9.

Here, in a rearward state (the right direction in FIG. 1) of the piston rod 7, the pilot operation opening valve 18 is closed, naturally, high pressure hydraulic fluid flowing from the accumulator 17 is interrupted. When normal injection control is started from the rearward position of the piston rod 7, the pilot operation opening valve 18 is opened to feed the high pressure oil from the accumulator 17 to the head of the injecting cylinder 9.

The control means 4 is composed of a micro-computer or the like, which includes an input means 19 for inputting various injection condition data or the like for operating the injection control, and an indication means 20, such as CRT or the like, for indicating the result of the input or the information of the control.

Between the control means 4 and the pilot valve 12, a D/A converter 21 converting a digital signal output outputted from the control means 4 to an analog signal output, and a servo amplifier 22 amplifying the analog signal outputted from the D/A converter 21 are provided.

The die casting machine 1 is structured to operate the injection control during a feedback control caused by the control means 4. More specifically, a detected signal K1 of the speed movement and the stroke movement of the piston rod 7, which is detected by the magnet sensor 10, is sent as a feedback signal to the control means 4, whereupon the control means 4 compares the detected signal K1 with various injection condition data or the like defined by being input from the input means 19. In the quality of response to the result of the comparison, a control signal K2 is sent to the D/A converter 21, as the analog signal to the servo amplifier 22, and as a control signal K3, which is amplified by the servo amplifier 22, to the pilot valve 12, thereby the pilot valve 12 is operated with the feedback control.

The servo valve 3 is provided with a displacement detection device 23 detecting displacement of a spool of the main valve 11, and a displacement detection device 24 detecting displacement of a spool of the pilot valve 12. The die casting machine is structured so that each of the detected signals K4 and K5 outputted from the displacement detection devices 23 and 24 are inputted to the servo amplifier 22 to be compared with each other, and further, by operating the feedback control of the minor-loop correcting the control signal K3 outputted from the servo amplifier 22 to properly make the proportion between the spool displacement of the main valve 11 and the spool displacement of the pilot valve 12, the main valve 11 is controlled as the control signal K2 is outputted from the control means 4.

The die casting machine is provided with a varying pressure detection device 25 for detecting the pressure force of the piston rod 7 by detecting different pressures between the rod side and the piston side, in which a load-compensation control is operated by using the pressure force of the piston rod 7, detected by the varying pressure detection device 25, and the actual speed movement and stroke movement of the piston rod 7 measured by the magnet sensor 10.

FIG. 2 shows the inner structure of the servo valve 3 in detail. In FIG. 2, the servo valve 3 includes the aforementioned servo valve body 13, provided adjacent to the cylinder body 6, and a spool 26, sidably thrust into the servo valve body 13, in which it is structured that the servo valve 3 is directly attached to the cylinder body 6. Here, the direct attachment of the servo valve 3 to the cylinder body 6 includes the case that the servo valve body 13 and the cylinder body 6 are mutually screwed with a fixer such as a bolt or the like (not shown) or are continuously formed by being welded.

The spool 26 has a first pressurized oil flowing channel 27 releasing the pressurized oil, sent from the rod side port 13A, to the tank side port 13C and a second pressurized oil flowing channel 28 for releasing the pressurized oil, sent from the pressurized oil feeding port 13B, to the rod side port 13A. The cylinder body 6 is formed therein with a main channel 6A connecting the rod side port 13A and the inside of the cylinder body 6.

The first pressurized oil flowing channel 27 is a first ring groove 26A formed on the outer circumference portion of the spool 26, and the second pressurized oil flowing channel 28 is a hole portion 26B, formed in the inside of the spool 26, and a second ring groove 26C, formed on the outer circumference portion of the spool 26 to connect to the hole portion 26B.

The first ring groove 26A is formed to have a large width and depth measurement between a first land area 26D and a second land area 26E provided on the outer circumference portion of the spool 26. The first land area 26D interrupts the pressurized oil feeding port 13B and the tank side port 13C. The second land area 26E has sufficient width for closing an opening portion of the rod side port 13A.

The hole portion 26B is composed of a first through hole 26F of large diameter which is formed at the center of the spool shaft 26, and a number of second through holes 26G of small diameter which are connected to the first through hole 26F and the second ring groove 26C and are formed in the axis direction of the spool 26. The first through hole 26F has one end opposing from the pressurized oil feeding port 13B and the other end opposing from an attachment plate 23A of the displacement detection device 23. On the attachment plate 23A, an oil feed hole 23B is formed to allow the pressurized oil to flow between the first through hole 26F and a chamber 13D formed opposite the pressurized oil feeding port 13B of the servo valve body 13.

The second ring groove 26C is formed between the second land area 26E and a third land area 26H which are provided on the outer circumference portion of the spool 26.

Adjacent to the third land area 26H, a piston portion 261 is provided on the outer circumference portion of the spool 26.

In the inside of the servo valve body 13, a first oil chamber 13E and a second oil chamber 13F are formed at the position to sandwich the piston portion 26I, in which the oil chambers 13E and 13F are relatively continued through the pilot valve 12 and the first and second oil channels 13G and 13H. The first and second oil channels 13G and 13H are collectively arranged at the same place to make the shortest distance between the oil chambers 13E and 13F and the pilot valve 12.

The spool 12A of the pilot valve 12 can be shifted among a first position where the hydraulic fluid is sent through the first oil channel 13G to the first oil chamber 13E, a second position where the hydraulic fluid is sent through the second oil channel 13H to the second oil chamber 13F, and a third position where the hydraulic fluid is sent neither to the first nor second oil channel 13G and 13H.

A method for controlling the injection in the die casting machine of the embodiment will be explained below with reference to FIG. 3 and FIG. 4. In order to start the injection control, while the opening portion of the rod side port 13A is closed by the second land area 26E of the main valve 11, the pilot operation opening valve 18 is opened to feed the high pressurized oil that flows from the accumulator 17 toward the head of the injecting cylinder 9. And then, the injection operation starts by causing the piston rod 7 of the injecting cylinder 9 to move forward, and the molten material is fed into the mold (not shown), when closing the rod side port 13A, so that the piston rod 7 is moved forward at low speed, thereby the low-speed injection is operated.

Figure 3:
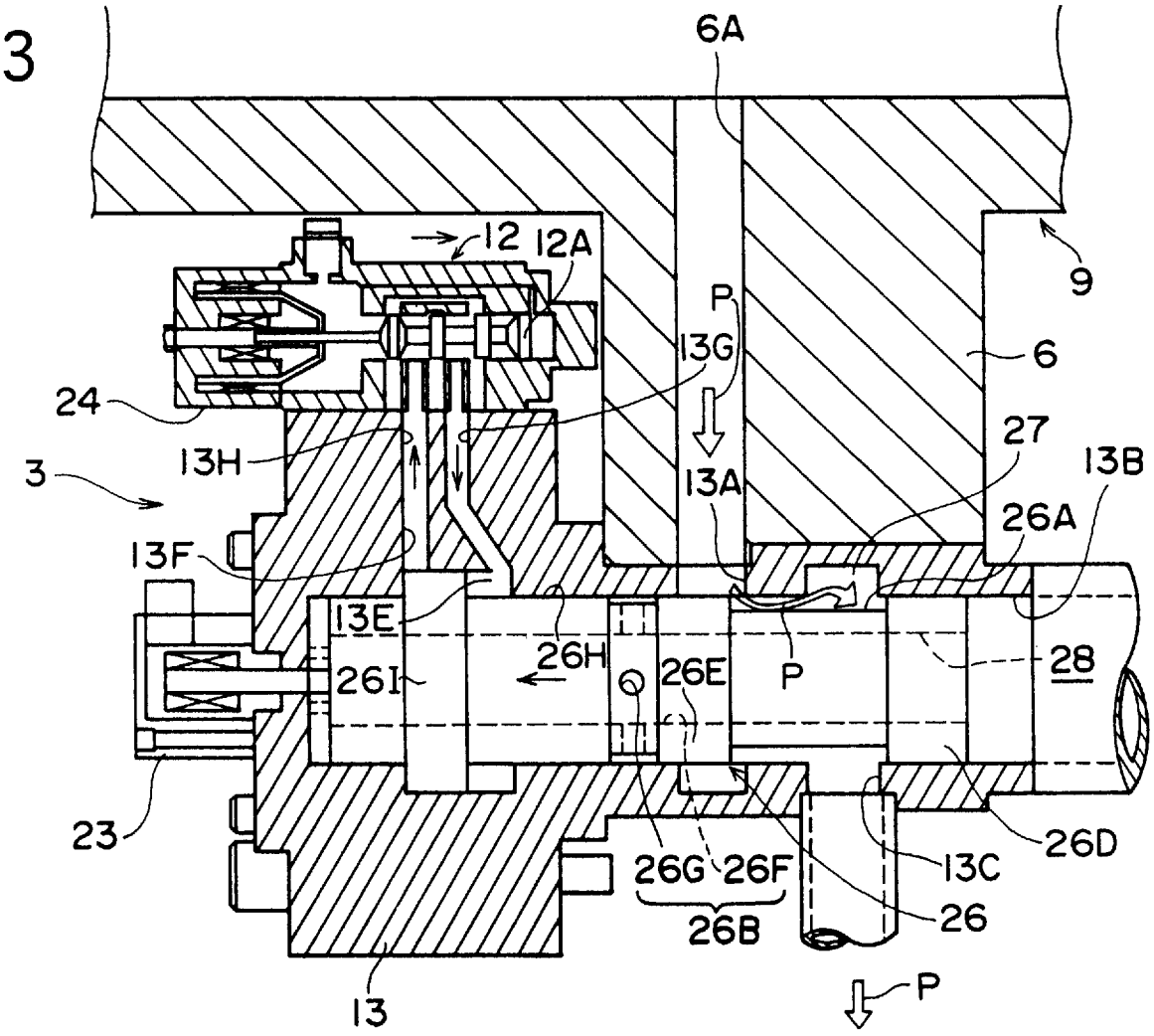
FIG. 3 is a sectional view showing a state in which a servo valve composing the injection device is moved in one direction.

After that, as shown in FIG. 3, the hydraulic fluid is sent through the first oil channel 13G to the oil chamber 13E by operating the pilot valve 12, whereupon the spool 26 of the main valve 11 is moved toward the left side in the drawing, further, the pressurized oil in the side of the piston rod 7 of the injection cylinder device 2 is sent from the rod side port 13A through the first pressurized oil flow channel 27 to the tank side port 13C (see arrow P), whereby the forward-moving speed of the piston rod 7 is shifted from low speed to high speed. The first pressurized oil flow channel 27 is large, therefore, the pressurized oil in the injection cylinder device 2 is sent rapidly to the tank side port 13C, so that the shift from low-speed injection to high-speed injection is operated in a short time.

Thereafter, the spool 26 of the main valve 11 is moved toward the right side in the drawing to be in the state as shown in FIG. 2. The second land area 26E of the main valve 11 closes the opening portion of the rod side port 13A, so that the piston rod 7 is acted upon by the brake effect, therefore, the piston rod 7 is moved at a constant speed.

The molten material is fed into the mold as the piston rod 7 is moved forward, but, after a lapse beyond the specified time from the feed of the molten material into the mold, the pilot valve 12 is operated to cause the spool 26 of the main valve 11 to move toward the left side in the drawing again (see FIG. 3). Naturally, the pressurized oil in the piston rod 7 of the injecting cylinder 9 is sent from the rod side port 13A through the first pressurized oil flow channel 27 to the tank side port 13C, so that the pressure on the side of the piston rod 7 of the injecting cylinder 9 is rapidly decreased.

Figure 4:
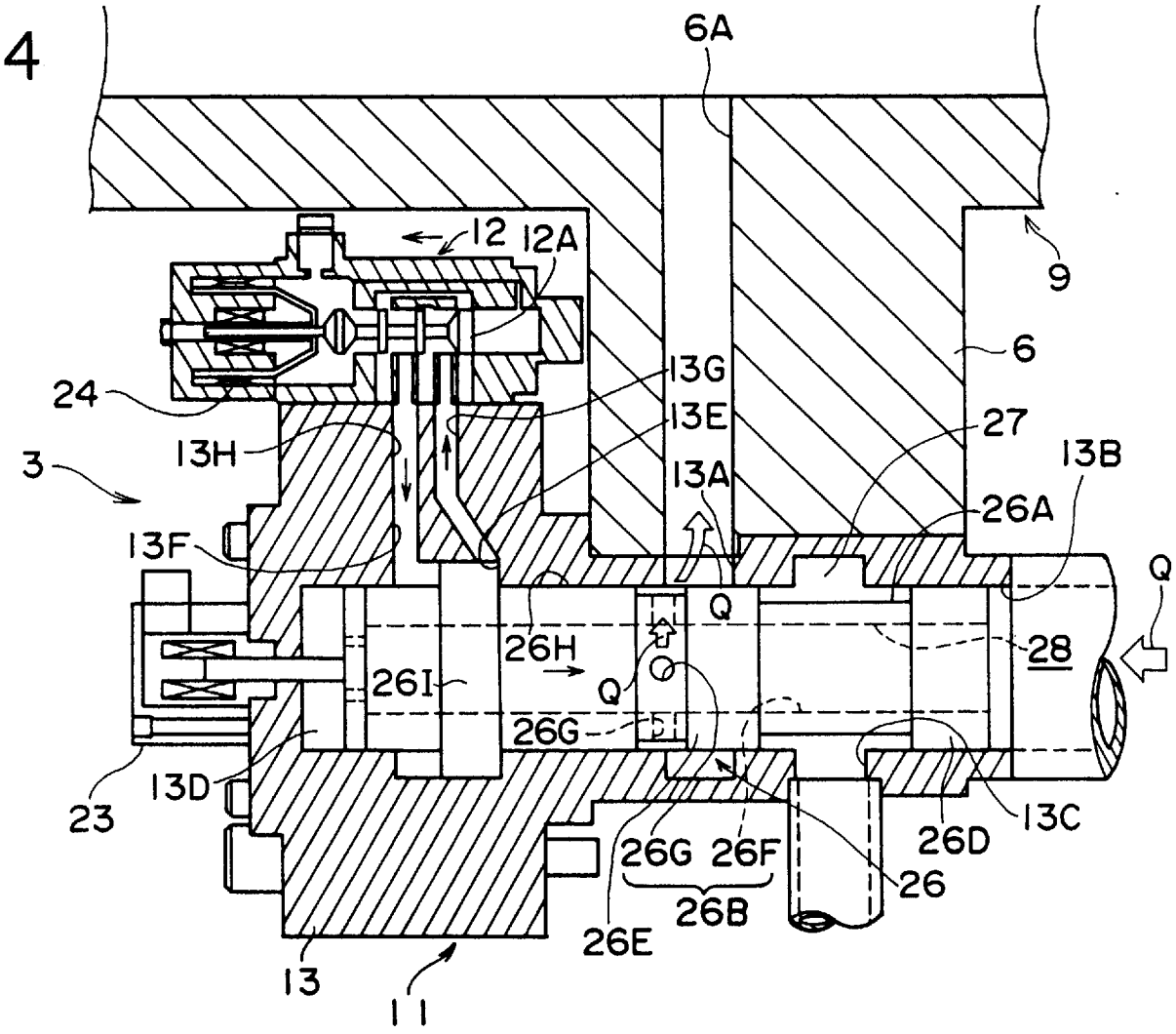
FIG. 4 is a sectional view showing a state in which the servo valve composing the injection device is moved in the other direction.

At this juncture, in order to reset the piston rod 7 to the initial position, as shown in FIG. 4, the pilot valve 12 is operated to cause the hydraulic fluid to flow through the second oil channel 13H to the second oil chamber 13F, whereupon the spool 26 of the main valve 11 is moved toward the further most side on the right of the drawing, further, the pressurized oil on the side of the piston rod 7 of the injecting cylinder 9 is sent from the pressurized oil feeding port 13B through the second pressurized oil flow channel 28 to the rod side port 13A (see arrow Q), therefore, the piston rod 7 of the injecting cylinder 9 is moved backward.

In consequence, according to the embodiment, the injection device 5 of the die casting machine is structured to include the injecting cylinder 9, which the piston 8 connected to the piston rod 7 is slidably thrust into the cylinder body 6 and the pressurized oil is fed from the pressurized oil source to the side of the piston and further flows out from the side of the piston rod, and the servo valve 3 controlling the injection speed of the injection cylinder device 2 by controlling the flow of the pressurized oil that flows from the injecting cylinder 9, while directly attaching the servo valve 3 to the cylinder body 6 of the injecting cylinder 9, in which the servo valve 3 includes the servo valve body 13, provided adjacent to the cylinder body 6, and the spool 26, slidably thrust into the servo valve body 13, with the servo valve body 13 having the rod side port 13A connected to the side of the piston rod of the injecting cylinder 9, the pressurized oil feeding port 13B fed with the pressurized oil from the pressurized oil source 16 and the tank side port 13C for exhausting the pressurized oil to the drain, the spool 26 having the first pressurized oil flow channel 27 having the pressurized oil, fed from the rod side port 13A, to flow to the tank side port 13C and the second pressurized oil flow channel 28 for the pressurized oil, fed from the pressurized oil feeding port 13B, to flow to the rod side port 13A, with the result that the resistance in the channel can be smaller by shortening the main channel 6A connecting the injecting cylinder 9 and the servo valve 3. Therefore, the large amount of pressurized oil can flow into the main channel 6A, resulting in the satisfactory quality of response of the injection device 5 of the die casting machine.

From the view that the first pressurized oil flow channel 27 is the first ring groove 26A formed on the outer circumference portion of the spool 26, the width and depth of the first ring groove 26A can be larger, therefore, the quality of response of the injection device of the die casting machine can be improved by allowing the large amount of pressurized oil to flow in the inside of the servo valve 3. Furthermore, the second pressurized oil flow channel 28 is composed of the hole portion 26B opened in the inside of the spool 26 and the second ring groove 26C formed on the outer circumference portion of the spool 26 to connect to the hole portion 26B, whereby weight-reduction is attained by having the spool 26 formed as a hollow portion, and the quality of response of the spool 26 itself is improved, resulting in the further improved quality of response of the injection device 5 of the die casting machine.

In the embodiment, with the oil feed hole 23B and the first through hole 26F, the pressurized oil can flow between the pressurized oil feeding port 13B and the chamber 13D of the servo valve body 13, so that the pressure of the pressurized oil in the spool 26 is balanced, resulting in the smooth movement of the spool 26. Further, the inside of the servo valve body 13 and the pilot valve 12 are connected through the first and second oil channels 13G and 13H and the first and second oil chambers 13E and 13F, in which the first and second oil channels 13G and 13H are arranged to make the shortest distance between the inside of the servo valve body 13 and the pilot valve 12, whereby the resistance in the channel of the oil channels 13G and 13H can be minimal, with the result that the extremely high speed response of the spool 26 is allowed by increasing the natural oscillation frequency of the relating parts and system. Here, the natural oscillation frequency of the relating parts and system, including the oil channels 13G and 13H, the piston portion 26I and the oil chambers 13E and 13F, is defined to be, for example, 400 Hz, whereby the frequency response characteristic of the servo family is empirically allowed to be a third to a fifth of the aforementioned natural oscillation frequency of the relating parts and system, with the result that the frequency response characteristic of the servo family can be increased by approximately 100 Hz.

Incidentally, the present invention is not intended to be limited to the aforementioned embodiment, and the following modifications are included therein within the scope capable of attaining the object of the present invention.

For instance, in the aforementioned embodiment, the servo valve 3 is composed of the main valve 11 and the pilot valve 12, in the present invention, however, the servo valve 3 is not intended to be limited to the structure of the aforementioned embodiment, therefore, the servo valve 3 may be composed of the main valve 11. Further, the main valve 11 is a three-way valve having the rod side port 13A connecting to the side of the piston rod of the injection cylinder device 2, the pressurized oil feeding port 13B fed with the pressurized oil from the pressurized oil source 16 and the tank side port 13C for exhausting the pressurized oil to the drain, in the present invention, however, the main valve 11 can be a four-way valve.

As described thus far, according to the present invention, the injection device of the die casting machine is structured to include the injecting cylinder, in which the piston connected to the piston rod is slidably thrust into the cylinder body and the pressurized oil is fed from the pressurized oil source to the piston side and further flows out from the side of the piston rod, and the servo valve controlling the injection speed of the injection cylinder device by controlling the flow of the pressurized oil that flows from the cylinder, with directly attaching the servo valve to the cylinder body of the injecting cylinder, in which the servo valve includes the servo valve body, provided adjacent the cylinder body, and the spool, sidably thrust into the servo valve body, with the servo valve body having the rod side port connected to the side of the piston rod of the injecting cylinder, the pressurized oil feeding port fed with the pressurized oil from the pressurized oil source and the tank side port for exhausting the pressurized oil to the drain, the spool having the first pressurized oil flow channel for the pressurized oil, fed from the rod side port, to flow to the tank side port and the second pressurized oil flow channel for feeding the pressurized oil, fed from the pressurized oil feeding port, to the rod side port, with the result that the resistance in the channel can be smaller by shortening the main channel connecting the injecting cylinder and the servo valve, therefore, the quality of response of the injection device of the die casting machine is improved.

In consequence, the product parts with reduced weight which are required by an automaker or the like are allowed to be cast.

What is claimed is:

1. An injection device of a die casting machine, which includes an injecting cylinder, having a cylinder body, a piston thrust into the cylinder body to be slid, and a piston rod connected to the piston, with pressurized oil being fed from a pressurized oil source to the piston side and further flowing out from the side of the piston rod, and a servo valve, controlling the injection speed of the injecting cylinder by controlling the amount of flow of pressurized oil that flows from the injecting cylinder, said injection device of the die casting machine comprising:

a servo valve body provided adjacent to the cylinder body in the servo valve directly attached to the cylinder body of the injecting cylinder; and a spool thrust into said servo valve body in a sliding motion in the servo valve directly attached to the cylinder body of the injecting cylinder, said servo valve body including a rod side port connecting to the side of the piston rod of the injecting cylinder, a pressurized oil feeding port fed with the pressurized oil from the pressurized oil source, and a tank side port for exhausting the pressurized oil to drain, and said spool including a first pressurized oil flow channel for the pressurized oil, fed from the rod side port, to flow to the tank side port and a second pressurized oil flow channel for the pressurized oil, fed from the pressurized oil feeding port, to flow to the rod side port.

2. The injection device of the die casting machine according to claim 1, wherein the first pressurized oil flow channel is a first ring groove formed on the outer circumference portion of said spool.

3. The injection device of the die casting machine according to claim 1, wherein the second pressurized oil flow channel includes a hole portion formed in the inside of said spool and a second ring groove formed on the outer circumference portion of said spool to connect to the hole portion.

4. The injection device of the die casting machine according to claim 3, wherein the hole portion includes a first through hole of large diameter, formed to the shaft center of said spool, and a second through hole of small diameter, connecting the first through hole and said second ring groove and formed in the axis direction of said spool.

5. The injection device of the die casting machine according to claim 4, wherein the second through hole has a number of holes.

6. The injection device of the die casting machine according to claim 1, wherein the servo valve is a two-stage servo valve including a main valve having said servo valve body and a pilot valve operating the main valve.

7. The injection device of the die casting machine according to claim 6, wherein the servo valve includes a displacement detection device for detecting displacement of a spool of said main valve and a displacement detection device for detecting displacement of a spool of the pilot valve, said two displacement detection devices being connected to a control means for controlling to properly make the proportion between the spool displacement of said main valve and the spool displacement of the pilot valve.

8. The injection device of the die casting machine according to claim 1, wherein said servo valve body has a chamber at the opposite side of said spool, the pressurized oil flows between the chamber and the pressurized oil feeding port.

9. The injection device of the die casting machine according to claim 6, wherein the inside of said servo valve body and the pilot valve are connected through a first oil channel, a second oil channel, a first oil chamber and a second oil chamber, the first and second oil channels being arranged to make the shortest distance between the inside of said servo valve body and the pilot valve.

* * * * *